United States Patent [19]

Cuesta et al.

[11] Patent Number: 4,634,085

[45] Date of Patent: Jan. 6, 1987

[54] WHISTLE KITE

[76] Inventors: Eugenio M. Cuesta; George Spector, both of 233 Broadway, RM 3615, New York, N.Y. 10007

[21] Appl. No.: 751,273

[22] Filed: Jul. 2, 1985

[51] Int. Cl.[4] ..... B64C 31/06

[52] U.S. Cl. ..... 244/153 R; 244/155 R

[58] Field of Search ..... 244/153 R, 155 R, 153 A, 244/154; 446/206, 207, 208, 213, 216, 215, 415, 252, 47, 48

[56] References Cited

U.S. PATENT DOCUMENTS 729,891 6/1903 Pierce ..... 446/215

2,394,366 2/1946 Chu et al. ..... 244/153 R 2,419,441 4/1947 De Roda ..... 244/153 R 2,488,118 11/1949 Cobb et al. ..... 244/153 R

*Primary Examiner*—Galen Barefoot

*Assistant Examiner*—Lynn M. Fiorito

[57] ABSTRACT

A whistle kite is provided and contains a sound making device on its outer periphery which includes a flexible strap for emitting a sound like an airplane propeller as air passes by when the kite flies. In a modified form an adjustable tension holder is used which is activated by wind speed to vary pitch of the sound emitted by the flexible strap.

3 Claims, 3 Drawing Figures

WHISTLE KITE

BACKGROUND OF THE INVENTION

The instant invention relates generally to flying toy devices and more specifically it relates to a whistle kite.

Numerous flying toy devices have been provided in prior art that are adapted to emit a distinctive sound during flight. For example, U.S. Pat. Nos. numbered 3,900,987; 4,246,720 and 4,336,915 all are illustrative of such prior art. While these units may be suitable for the particular purpose to which they address, they would not be as suitable for the purposes of the present invention as heretofore described.

SUMMARY OF THE INVENTION

A principle object of the present invention is to provide a whistle kite that has a sound making device on its outer periphery for emitting a sound as a function of the flying action to thereby add to the user's enjoyment of the kite.

Another object is to provide a whistle kite whereby the sound making device includes a rubber band strap which eminates a sound like a propeller of an airplane when it vibrates through the air.

An additional object is to provide a whistle kite whereby the sound making device includes an adjustable tension holder that has a deflector blade which is activated by wind speed to vary pitch of the sound from the rubber band strap.

A further object is to provide a whistle kite that is economical in cost to manufacture.

A still further object is to provide a whistle kite that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
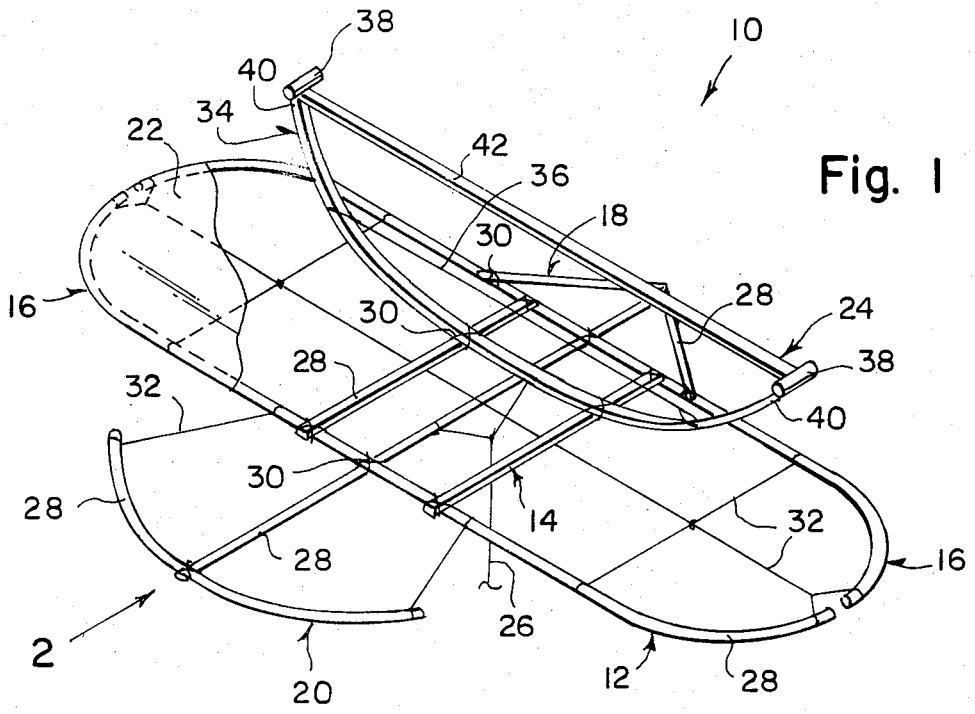
FIG. 1 is a perspective view of the invention with the cover sheet broken away to see the flat frame structure.
Figure 2:
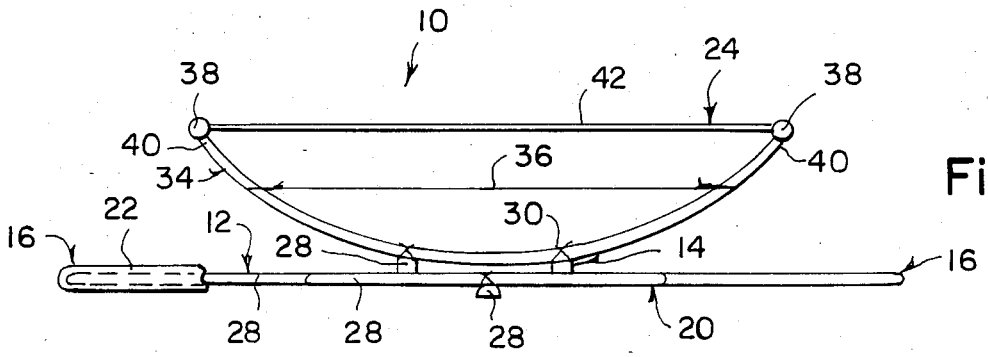
FIG. 2 is a rear view as indicated by arrow 2 in FIG. 1.
Figure 3:
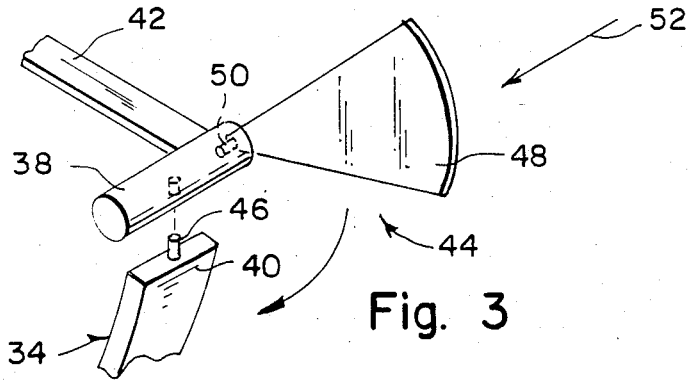
FIG. 3 is an enlarged perspective view broken away and partly exploded showing an adjustable tension holder having a deflector blade that is activated by wind speed to vary pitch of the sound from the flexible strap.

Turning now descriptively to the drawings, in which similar reference characters denote similar elements throughout the several views, FIGS. 1 and 2 illustrates a whistle kite 10 that includes a flat frame structure 12 formed in a shape of an airplane that has a fuselage portion 14, a pair of wing portions 16, 16, a nose portion 18 and a tail portion 20. A cover sheet 22 is secured to the flat frame structure 12.

An air activated sound making device 24 is mounted on the fuselage portion 14 of the flat frame structure 12 to be activated by air passing by as the kite 10 flies. A flying line 26 is attached to the fuselage portion 14 of the flat frame structure 12.

The flat frame structure 12 includes a plurality of sticks 28 some of which are curved. A plurality of line lashings 30 attach the sticks 28 together. A plurality of string braces 32 hold the sticks 28 together in stabilized relationships.

The air activated sound making device 24 includes a bow-shaped member 34 transversely mounted on top of the fuselage portion 14 by the line lashings 30. A stabilizing brace wire 36 extends across middle of the bow-shaped member 34 and a pair of clamps 38, 38 are provided. Each clamp 38 is positioned on each end 40 of the bowshaped member 34. A flexible strap 42 extends between the clamps 38, 38 which emits a sound like an airplane propeller when it vibrates through the air.

FIG. 4 shows an adjustable tension holder 44 which includes one of the clamps 38 being pivotable on a pin 46 on the end 40 of the bow-shaped member 34. A deflector blade 48 is affixed at 50 to the pivotable clamp 38. It is activated by wind speed, as indicated by arrow 52 to turn the pivotable clamp 38. This stretches the flexible strap 42 to vary pitch of the sound emitted from the flexible strap.

The sticks 28 and the bow-shaped member 34 are fabricated from bamboo. The cover sheet 2 is fabricated from plastic and the flexible strap 42 is fabricated from rubber or preferably "Buri", a dried leaf fiber bearing plant.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A whistle kite which comprises:

(a) a flat frame structure formed in a shape of an airplane having a fuselage portion, a pair of wing portions, a nose portion and a tail portion;

(b) a cover sheet secured to said flat frame structure;

(c) an air activated sound making device mounted on said fuselage portion of said flat frame structure to be activated by air passing by as said kite flies; and (d) a flying line attached to said fuselage portion of said flat frame structure, wherein said flat frame structure includes (e) a plurality of sticks some of which are curved;

(f) a plurality of line lashings so attach said sticks together;

(g) a plurality of string braces to hold said sticks together in stabilized relationships, wherein said air activated sound making device includes:

(h) a bow-shaped member transversely mounted on top of said fuselage portion by said line lashings;

(i) a stabilizing brace wire extending across middle of said bow-shaped member;

(j) a pair of clamps, each said clamp positioned on each end of said bow-shaped member;

(k) a flexible strap extended between said clamps which emits a sound like an airplane propeller when it vibrates through said air, further comprising an adjustable tension holder which includes:

(l) one of said clamps being pivotable on said end of said bow-shaped member;

(m) a deflector blade affixed to said pivotable clamp which is activated by wind speed to turn said pivotable clamp, thus stretching said flexible strap to vary pitch of said sound emitted from said flexible strap.

2. A whistle kite as recited in claim 1, wherein said sticks and said bow-shaped member are fabricated from bamboo.

3. A whistle kite as recited in claim 2, wherein said cover sheet is fabricated from plastic and said flexible strap is fabricated from rubber.

* * * * *